United States Patent [19]

Tyler et al.

[11] Patent Number: 4,775,341

[45] Date of Patent: Oct. 4, 1988

[54] FOIL SYSTEM FOR JET PROPELLED AQUATIC VEHICLE

[75] Inventors: Nelson Tyler, Van Nuys; Robert T. DeVault, Felton; Ralph P. Maloof, Calabasas, all of Calif.

[73] Assignee: Wetco Industries, Chatsworth, Calif.

[21] Appl. No.: 883,757

[22] Filed: Jul. 9, 1986

[51] Int. Cl.[4] ..... B63H 11/04

[52] U.S. Cl. ..... 440/38; 440/47; 60/221

[58] Field of Search ..... 440/38, 46, 47, 66–70; 60/220, 221; 244/53 B

[56] References Cited

U.S. PATENT DOCUMENTS

| | | | |
|---|---|---|---|
| 2,149,155 | 2/1939 | Anderson | 440/38 |
| 3,041,831 | 7/1962 | Singelmann | 440/38 |
| 3,082,732 | 3/1963 | Stallmann | 440/38 |
| 3,253,567 | 5/1966 | Patton, Jr. | 440/46 |
| 3,283,737 | 11/1966 | Gongwer | 440/38 |
| 3,365,891 | 1/1968 | Williams | 440/38 |
| 3,589,325 | 6/1971 | Tattersall | 440/38 |
| 3,640,071 | 2/1972 | Corlett | 440/68 |
| 3,757,728 | 9/1973 | Rhoda | 440/38 |
| 3,942,463 | 3/1976 | Johnson, Jr. et al. | 440/47 |
| 3,943,876 | 3/1976 | Kiekhaefer | 440/47 |
| 4,055,140 | 10/1977 | Kirchhan | 440/46 |
| 4,237,812 | 12/1980 | Richardson | 440/46 |
| 4,325,699 | 4/1982 | Castoldi | 440/47 |
| 4,373,919 | 2/1983 | Strangeland | 440/46 |
| 4,449,944 | 5/1984 | Baker et al. | 440/47 |

*Primary Examiner*—Joseph F. Peters, Jr.
*Assistant Examiner*—Edwin L. Swinehart
*Attorney, Agent, or Firm*—Fulwider, Patton, Rieber, Lee & Utecht

[57] ABSTRACT

Water directing apparatus for the jet pump inlet of a watercraft having a planing surface within which the inlet is formed. The apparatus is carried by the planing surface and includes a pair of laterally spaced apart, longitudinally extending side fins projecting downwardly of the planing surface. Curvilinear, transversely disposed upstream and downstream vanes are oriented to direct water into the inlet, the angles of attack of the vanes being established to direct boundary layer water into the inlet without separation. The vane combination achieves water flow directional change with minimum drag and flow separation. An embodiment is disclosed employing a vane movable in response to inlet passage pressure.

9 Claims, 1 Drawing Sheet

FOIL SYSTEM FOR JET PROPELLED AQUATIC VEHICLE

BACKGROUND OF THE INVENTION

1. Field of the Invention

The present invention relates to water directing apparatus for changing the streamlines of water flowing across the planing surface of a jet powered watercraft into the inlet of the jet pump inlet passage with minimum drag and flow separation.

b 2. Description of the Prior Art

Jet powered watercraft are driven by a pump impeller discharging water through a rearwardly directed discharge nozzle. The impeller draws water from a forwardly and downwardly extending pump inlet passage which terminates in an inlet located in a flat portion of the watercraft planing surface. The planing surface may be in the hull in certain types of watercraft, or located in a ski in other designs. In either event, the pump inlet passage is relatively steep to conserve space in the watercraft and a combination of pump suction and ram effect is relied upon to bring water to the impeller.

Water is drawn into the inlet passage primarily through pump suction on start-up and at low speeds. As watercraft speed increases water flow in the inlet passage becomes turbulent and flow separation occurs, particularly in the sloping upper forward portion of the inlet passage. This has an adverse effect on the efficiency and overall performance of the jet pump system.

A related problem is the tendency of the watercraft planing surface to bounce out of the water during rough water conditions. Since the jet pump is essentially a constant power device, when the planing surface separates from the water, air is ingested, cavitation occurs, and pump suction and jet drive are lost. The jet drive abruptly resumes when the planing surface drops to the water. This full onfull off action unduly stresses the structure and gives a poor ride, effects which are even more pronounced in smaller watercraft such as the "WETBIKE" watercraft described in U.S. Pat. No. 3,948,206, issued Apr. 6, 1976 to Nelson Tyler.

One solution to the problem of achieving smooth redirection of water into a jet pump inlet passage is disclosed in U.S. Pat. No. 3,757,728, issued Sept. 11, 1973 to Ralph A. Rhoda. Rhoda provides a guide vane whose leading edge he requires to be located outwardly and a substantial distance forwardly of the inlet of the pump inlet passage. He further requires that the trailing or downstream edge of the guide vane be located a substantial distance deep within the pump inlet passage. The concept is apparently to extend the guide vane sufficiently into the inlet passage that water flow is divided into upper and lower flow portions in a manner analogous to the way in which a pipe elbow changes the direction of fluid flow. In effect, the pipe inner surfaces extend from a point well forward of the inlet passage and empty deep within the inlet passage.

U.S. Pat. No. 4,237,812, issued Dec. 9, 1980 to Jerald S. Richardson discloses yet another means to facilitate induction of water into the inlet of a jet pump, in this case a jet pump for a jet propelled ski craft. Richardson provides a grating for attachment across the pump inlet. The single opening in the grating has a rearward terminus in the form of a single concave scoop located immediately adjacent the downstream edge of the pump inlet.

The water directing systems of these patents and others of the prior art are either ineffective to direct the boundary layer water flow into the inlet without turbulence and flow separation, or they are relatively large and complex, and extend deep within the pump inlet passage to define internal conduits or pipes to turn the water flow.

SUMMARY OF THE INVENTION

According to the present invention, a water directing apparatus is provided which utilizes a plurality of transversely extending foils or vanes disposed below the pump inlet. They are operative in succession to smoothly turn the water into the inlet with minimum drag and flow separation. The vanes are characterized by an airfoil lift profile such that their undersurfaces develop low pressure areas which tend to pull the boat down into the water to reduce porpoising in rough water conditions.

The water directing apparatus in a preferred embodiment is quickly attachable to a flat portion of the watercraft planing surface immediately below the inlet to the pump inlet passage. The apparatus includes a pair of laterally spaced apart, longitudinally extending side fins which project downwardly, the pair of vanes being attached at their ends to the side fins. The upstream vane has an angle of attack less than that of the downstream vane so that the boundary layer adjacent the watercraft planing surface is first turned toward the pump inlet with minimum turbulence. Thereafter, the greater angle of attack of the downstream vane completes the turning action somewhat more abruptly. Although its angle of attack is greater, little turbulence occurs because the effective angle of attack of the downstream vane on the turned water approximates that of the upstream vane on the boundary layer.

Utilization of small vanes, unlike a pipe or conduit structure, influences the water flow field all around the vanes. Water approaching the vanes reacts to the pressure rise caused by the vanes, and the water turns without need for any relatively large water turning pipe-like surfaces extending deep into the throat of the pump inlet passage.

In one embodiment a vane is pivotally mounted below the inlet so as to be responsive to inlet passage pressures. At low intake pressures the vane pivots and tends to open the inlet, but pivots oppositely to tend to close the inlet at higher intake pressures.

Other aspects and advantages of the present invention will become apparent from the following more detailed description taken in conjunction with the accompanying drawings.

DESCRIPTION OF THE PREFERRED EMBODIMENT

Figure 1:
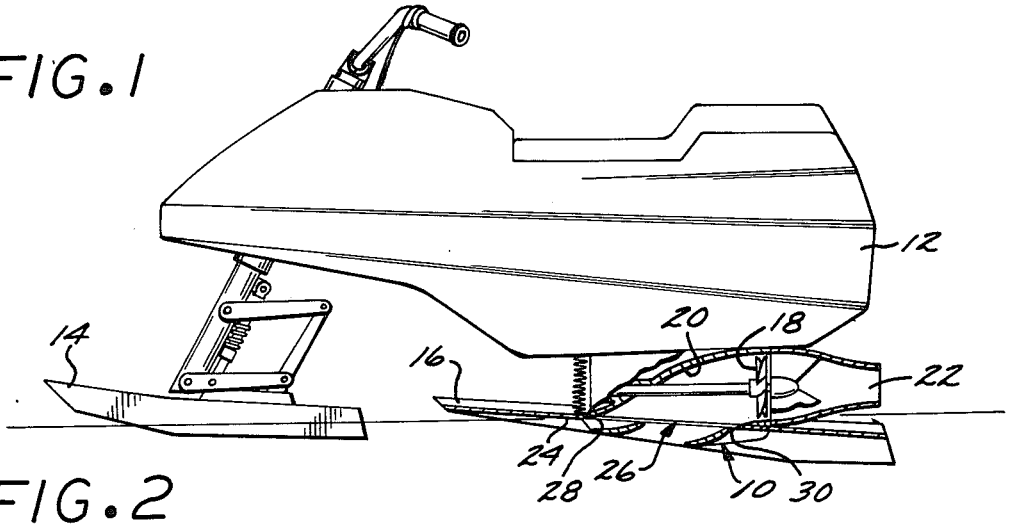
FIG. 1 is a side elevational view, partially in section, illustrating the present water directing apparatus mounted to a ski-like watercraft.

Referring now to the drawings, there is illustrated a water directing apparatus 10 in association with a type of watercraft more particularly disclosed in the U.S. Pat. No. 3,948,206 discussed above. As best seen in FIG. 1, the watercraft comprises an elongated hull 12, a front ski 14, a rear ski 16, a jet pump impeller 18 and a jet pump frame which defines a forwardly and downwardly extending pump inlet passage 20. The impeller 18 draws water from the passage 20 for acceleration and discharge at high velocity out of a discharge nozzle 22 to propel the watercraft forwardly.

The rear ski 16 is characterized by a longitudinally extending underside or planing surface having a generally flat portion 24 adapted to plane across the water at a predetermined acute trim angle relative to a horizontal plane corresponding to the water surface. The flat portion 24 includes an inlet 26 having parallel side edges and rounded upstream and downstream edges 28 and 30, respectively. During travel of the rear ski 16 through the water, water flowing along the ski planing surface portion 24 is retarded by friction and forms a low energy boundary layer.

The jet pump system of the watercraft is essentially a constant power device so that the volume of water flow remains approximately constant over the speed range of the watercraft. At low speeds the boundary layer is sucked into the inlet 26 by the impeller 18, the water flow particles following well-defined continuous paths or streamlines which contract as the water flow converges toward the inlet 26, accompanied by a pressure drop. As the watercraft moves faster, the streamlines in the passage 20 diverge, water flow along the streamlines slows, and the pressure rises. For water flow to occur through the inlet 26 the boundary layer must be turned upwardly into the inlet 26 to act against the increasing pressure.

The apparatus 10 is operative to direct water upwardly through the inlet 26 against the pressure gradiant with minimum turbulence, flow separation or discontinuity of the streamlines. This is done by guide vanes which impart the necessary vertical momentum change to the boundary layer. In the preferred embodiment of FIGS. 1–4, a fixed vane system is disclosed, while FIG. 5 illustrates a pivoted vane whose direction automatically varies according to the intake pressure in the inlet passage 20.

Figure 2:
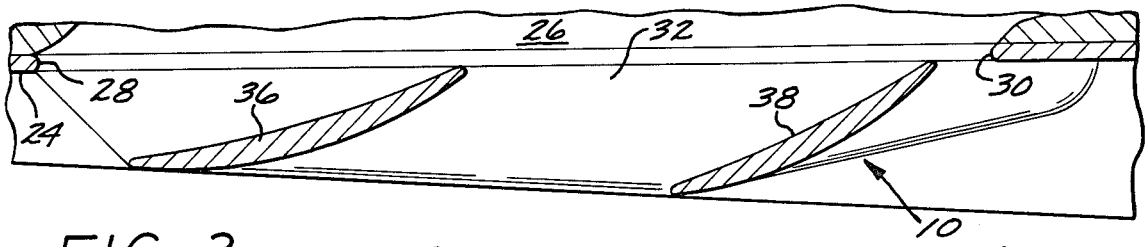
FIG. 2 is a enlarged longitudinal, crows sectional view of the water directing apparatus.
Figure 3:
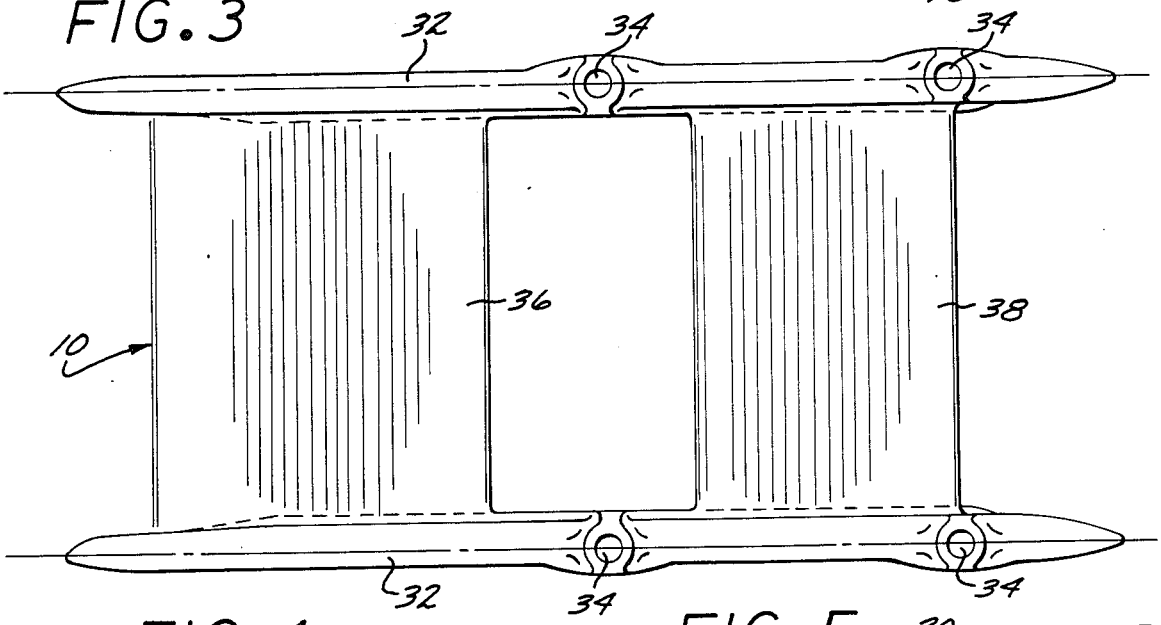
FIG. 3 is a bottom plan view of the water directing apparatus of FIG. 2.

As best seen in FIGS. 2 and 3, apparatus 10 comprises a pair of laterally spaced apart, longitudinally extending side fins 32 which project downwardly of the planing surface flat portion 24. They define a water flow channel generally designated by the numeral 35. Side fins 32 preferably have parallel side walls and smoothly rounded or tapered forward and rearward ends for minimum drag and minimum flow turbulence.

Each of the side fins 32 includes openings or bores 34 to receive headed machine bolts (not shown) which are adapted to be threaded into the flat portion 24 to secure apparatus 10 onto the planing surface. This arrangement permits the apparatus 10 to be installed as original equipment, or installed later upon watercraft not originally provided with it.

The apparatus 10 includes transversely extending upstream and downstream vanes 36 and 38, respectively, which are attached at their ends to the side fins 32. The vanes 36 and 38 are longitudinally spaced apart and are disposed at different angles of attack, as will later be described in connection with FIG. 2.

Vanes 36 and 38 each have a curvilinear profile analogous to a lifting airfoil, and are oriented to direct boundary layer water from the flow channel 35, through the inlet 26 and into the inlet passage 20. As seen in FIG. 1 and in the diagrammatic showing of FIG. 4, the leading edge of the upstream vane 36 is located adjacent the inlet upstream edge 28, preferably slightly downstream of it. It can be located below the edge 28 a distance of up to the width of the inlet 26, but a distance of 1.75 inches has been found to operate satisfactorily. A preferred arrangement is a compact or close grouping of the components of the apparatus 10.

The leading edge of the downstream vane 38 is located downstream of the trailing edge of the upstream vane 36, and its trailing edge is located forwardly of the inlet downstream edge 30. This arrangement divides the water flow into three paths or layers which smoothly merge within the inlet passage 20.

Flow separation from the surfaces of the vanes 36 and 38 is minimized by minimizing the thickness of the vanes, the thickness in one embodiment being approximately 0.37 inches. Flow separation is also minimized, and vane manufacture simplified, by making the opposite curvilinear surfaces of the vanes of generally constant radius. In addition, the curvilinear upper surfaces of both the upstream and downstream vanes 36 and 38 have a greater radius of curvature than their undersurfaces, respectively, to more smoothly turn the water flow into the inlet passage 20.

Figure 4:
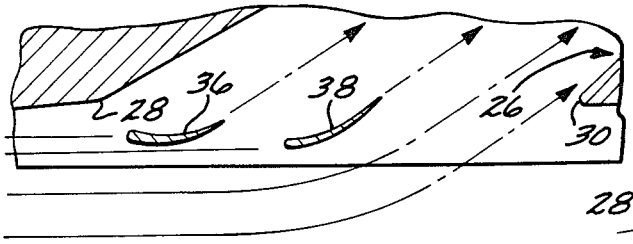
FIG. 4 is a diagrammatic showing of the effect of the pair of vanes of the present apparatus upon the water flow field adjacent the inlet to the pump inlet passage.
Figure 5:
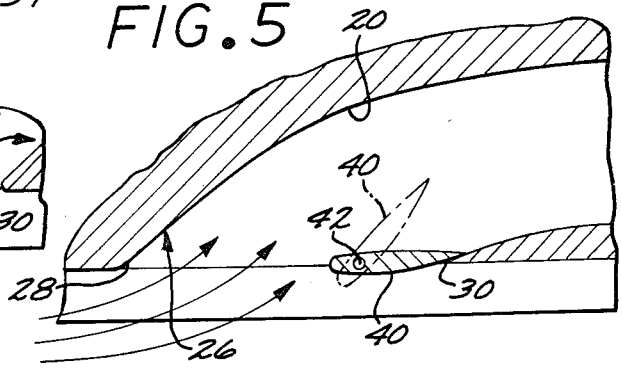
FIG. 5 is a generally diagrammatic showing of another embodiment of the present apparatus, comprising a vane pivotable according to the intake pressure in the pump inlet passage.

As seen in FIG. 4, the upstream vane 36 acts upon the streamlines of the boundary layer flowing over the planing surface flat portion 24, influencing the streamlines in advance of its leading edge and producing flow deflection around it. It has been found that an angle of attack in the lower end of a range of 0–10 degrees is preferred to prevent flow separation from the vane surfaces. A low angle of attack, close to zero degrees, causes a minimal pressure rise and yet is effective to turn the water smoothly toward the downstream vane 38. The vane 38 then acts on the water to turn it sufficiently to enter the inlet 26 with minimum energy loss.

The change of direction of the water relative to the plane of the planing surface is more abrupt at the downstream vane 38 but its turning effect closely corresponds to that of the upstream vane 36 because of the change in water direction already imparted by the upstream vane 36. The most effective relative angles of attack of the vanes 36 and 38 are easily established emperically for particular applications, as will be apparent to those skilled in the art.

The twin vane arrangement has been found to provide optimum re-direction of water in a compact space, and also be easily attachable adjacent the inlet 26. The relatively small vanes provide proper water flow direction by a lifting airfoil phenomenon, without recourse to pipe or conduit structure extending deep into the inlet passage 20. In addition, the downward force component developed by water flowing over the vanes 36 and 38, analogous to the lift force developed by an aircraft wing, tends to pull the watercraft down, reducing separation of the watercraft from the water during rough water conditions.

FIG. 5 illustrates a movable vane system, comprising a transversely extending vane 40 which carries a pivot pin 42 pivotally attached at its ends within suitable openings (not shown) in the side fins 32. The pin 42 is mounted relatively close to the leading edge of the vane 40. The trailing edge of the vane 40 is located to engage upon the downstream edge 30 of the inlet passage 20 on clockwise or closing pivotal movement to limit movement of the vane 40 past the generally horizontal position shown in full line. At low watercraft speeds the intake pressure in the inlet passage 20 drops, which acts upon the upper area of the vane 40 rearwardly of the pin 42 to pivot the trailing edge and establish the vane 40 at a relatively high angle of attack, as indicated in dotted outline in FIG. 5. At higher watercraft speeds the higher intake pressures tend to pivot the vane 40 downwardly to a lesser angle of attack, as seen in the full line position of FIG. 5, narrowing the inlet passage 20 and reducing the volume of entering water.

The embodiment of FIGS. 1–4 has provided a surprising combination of improved efficiency of the jet pump systems with which it has been associated, and more stable operating characteristics for the watercraft itself.

Various modifications and changes may be made with regard to the foregoing detailed description without departing from the spirit of the invention.

I claim:

1. In a jet powered watercraft having means forming a pump inlet passage extending forwardly and downwardly, a rearwardly directed discharge nozzle, an engine driven pump impeller operative to draw water from said pump inlet passage for discharge at high velocity out of said discharge nozzle, and a longitudinallly extending planing surface, said planing surface including a generally flat portion surrounding an inlet which opens into said pump inlet passage and which is characterized by an upstream edge and a downstream edge in the plane of said flat portion, the improvement comprising:

water directing apparatus carried upon said flat portion of said planing surface adjacent said inlet and having a pair of laterally spaced apart, longitudinally extending side fins projecting downwardly of said flat portion and defining a water flow channel; and transversely extending upstream and downstream vanes located below said flat portion and attached at their ends to said side fins, respectively; said upstream and downstream vanes having a curvilinear profile oriented to direct water from said watser flow channel, through said inlet and into said pump inlet passage, the leading edge of said upstream vane being located downstream of said upstream edge of said inlet, the leading edge of said downstream vane being located downstream of said leading edge of said upstream vane, the angle of attack of said upstream vane being in the lower end of a range of 0 to 10 degrees, and the angle of attack of said downstream vane being greater than the angle of attack of said upstream vane whereby said upstream vane tends to direct the boundary water layer from upstream of said inlet into said pump inlet passage without separation of flow from said upstream vane, and said downstream vane tends to more severely direct water downstream of said upstream vane into said pump inlet passage.

2. Water directing apparatus according to claim 1 wherein there is one said upstream vane and one downstream vane.

3. Water directing apparatus according to claim 1 wherein said side fins are generally parallel.

4. Water directing apparatus according to claim 1 wherein said side fins are detachably mounted to said planing surface.

5. Water directing apparatus according to claim 1 wherein said leading edge of said upstream vane is located approximately one and three-fourth inches below said said planing surface.

6. Water directing means according to claim 1 wherein the maximum thickness of each of said upstream and downstream vanes is approximately 0.37 inches.

7. Water directing means according to claim 1 wherein the opposite curvilinear surfaces of each of said upstream and downstream vanes is of generally constant radius.

8. Water directing apparatus according to claim 7 wherein the curvilinear uppersurfaces of said upstream and downstream vanes have a greater radius than the curvilinear undersurfaces of said upstream and downstream vanes, respectively.

9. In a jet powered watercraft having means forming a pump inlet passage extending forwardly and downwardly, a rearwardly directed discharge nozzle, an engine driven pump impeller operative to draw water from said pump inlet passage for discharge at high velocity out of said discharge nozzle, and a longitudinally extending planing surface, said planing surface including an inlet which opens into said pump inlet passage and which is characterized by an upstream edge and a downstream edge, the improvement comprising:

water directing apparatus carried upon said planing surface adjacent said inlet and having a pair of laterally spaced apart, longitudinally extending side fins projecting downwardly of said planing surface and defining a water flow channel; and a transversely extending unitary vane characterized by a leading edge and a trailing edge joined by a curvilinear central section, said vane being pivotally attached to said side fins for pivotal movement of said vane about a transverse axis downstream of the leading edge of the vane, said vane being pivotable between a flow position to direct water from said water flow channel, through said inlet and into said pump inlet passage, and a blocking position in which said trailing edge is engaged upon said downstream edge of said inlet, the leading edge of said vane being located downstream of said upstream edge of said inlet, the portion of said vane located downstream of said transverse axis being responsive to lower intake pressure in said pump inlet passage to pivot upwardly and widen said inlet at lower intake pressures, and to pivot downwardly and narrow said inlet at higher intake pressures.

* * * * *

UNITED STATES PATENT AND TRADEMARK OFFICE

CERTIFICATE OF CORRECTION

PATENT NO. : 4,775,341

DATED : October 4, 1988

INVENTOR(S) : Nelson Tyler et al.

It is certified that error appears in the above-identified patent and that said Letters Patent is hereby corrected as shown below:

Column 5, line 49, delete "watser" and insert --water--; and

Column 6, line 14, after "said" (first occurrence) insert --flat portion of--.

Signed and Sealed this

Fourteenth Day of February, 1989

*Attest:*

DONALD J. QUIGG

*Attesting Officer*

*Commissioner of Patents and Trademarks*